US007980165B2

(12) United States Patent
Misencik et al.

(10) Patent No.: US 7,980,165 B2
(45) Date of Patent: Jul. 19, 2011

(54) MODULAR BLAST-RESISTANT PANEL SYSTEM FOR REINFORCING EXISTING STRUCTURES

(75) Inventors: Stephen Misencik, Raleigh, NC (US); Paul E. Peterson, Jr., Apex, NC (US)

(73) Assignee: Martin Marietta Materials, Inc., Raleigh, NC (US)

( * ) Notice: Subject to any disclaimer, the term of this patent is extended or adjusted under 35 U.S.C. 154(b) by 66 days.

(21) Appl. No.: 11/866,801

(22) Filed: Oct. 3, 2007

(65) Prior Publication Data

US 2009/0090236 A1 Apr. 9, 2009

(51) Int. Cl.
*F41H 5/04* (2006.01)
*F41H 5/013* (2006.01)

(52) U.S. Cl. ..... 89/36.02; 89/36.04

(58) Field of Classification Search ..... 89/36.02, 89/36.04

See application file for complete search history.

(56) References Cited

U.S. PATENT DOCUMENTS 3,454,947 A * 7/1969 Wesch et al. ..... 342/1
5,014,593 A * 5/1991 Auyer et al. ..... 89/36.02
5,394,786 A * 3/1995 Gettle et al. ..... 86/50
5,723,807 A * 3/1998 Kuhn, II ..... 89/36.02
5,794,402 A 8/1998 Dumlao et al.
6,023,806 A 2/2000 Dumlao et al.
6,044,607 A 4/2000 Dumlao et al.
6,108,998 A 8/2000 Dumlao
6,645,333 B2 11/2003 Johnson et al.
6,676,785 B2 1/2004 Johnson et al.
6,698,331 B1 * 3/2004 Yu et al. ..... 89/36.02
7,601,654 B2 * 10/2009 Bhatnagar et al. ..... 442/135
2004/0118271 A1 * 6/2004 Puckett et al. ..... 89/36.02
2006/0060077 A1 * 3/2006 Lucuta et al. ..... 89/36.02
2006/0141165 A1 * 6/2006 Hassan et al. ..... 427/430.1

* cited by examiner

*Primary Examiner* — Stephen M Johnson
(74) *Attorney, Agent, or Firm* — Nelson Mullins Riley & Scarborough LLP

(57) ABSTRACT

Various embodiments of the present invention provide a blast-resistant reinforcement assembly and/or system for engaging a surface of an existing structure to protect the structure from an applied force, such as an explosive detonation. The assembly includes one or more energy absorbing panels that may be attached to the structure. The energy absorbing panels include a core material configured to absorb some portion of the applied force by pulverizing in response to the applied force. In some embodiments, the energy absorbing panels also include one or more ballistic-resistant composite panels configured to protect the core material and the underlying existing structure from debris. Some embodiments further provide one or more energy deflecting panels engaged with the plurality of energy absorbing panels so as to be disposed between the energy absorbing panels and the location of the applied force for at least partially deflecting the applied force.

24 Claims, 6 Drawing Sheets

MODULAR BLAST-RESISTANT PANEL SYSTEM FOR REINFORCING EXISTING STRUCTURES

FIELD OF THE INVENTION

The present invention is directed to a modular blast-resistant panel system. More specifically, the present invention provides a composite panel system for retrofitting existing structural elements for improved resistance to applied forces.

BACKGROUND OF THE INVENTION

Due to the worldwide increase in terrorist incidents, and the use of explosive devices in such incidents, there has been increased interest in building structures that are capable of withstanding very large applied forces (such as explosive blasts). Similarly, efforts have been made to retrofit existing structures with blast-resistant surfaces.

For example, some blast-resistant polymer coatings have been developed to "spray on" to existing masonry walls (such as concrete block and/or brick structures) in order to prevent the shattering of such structures in response to an explosive force. Such conventional blast-resistant coatings have proven effective for preventing the generation of potentially deadly debris by reducing the likelihood that such masonry structures shatter and/or decompose in response to the application of a blast force. While such conventional blast-resistant coatings are relatively easy to apply (via liquid spray, for example), they may fail to provide adequate blast resistance to preserve an existing structure during an excessive blast force (such as that accompanying the detonation of a relatively large explosive device).

Furthermore, such conventional blast-resistant coatings may not be effective for retrofitting some existing steel and/or cast iron structures for increased blast-resistance. For example, many existing structures, such as traffic structure systems and/or subterranean train structures are supported by relatively old cast iron structures having rusted, irregular surfaces and/or structural ribbing that may prevent an even coating of conventional "spray on" blast-resistant coatings. Furthermore, conventional blast-resistant polymer coatings may do little to further reinforce cast iron and/or poured concrete structures that may be subjected to very large blast forces originating inside the structure (for example, blast forces approaching and/or exceeding 50 kilopounds per square inch (ksi) that may be the result of large and/or powerful bombs that may be carried in luggage, in a vehicle, and/or pre-placed on an access pathway defined in a train structure).

In addition, it is well known that blast forces may be absorbed and/or mitigated using pumice powder and/or pebbles. For example, various military forces pack live ammunition in pumice. Because the pumice is air-filled and easily pulverized, it acts to absorb the explosive blast and/or shock should a single round of ammunition be ignited. This blast and/or shock absorption quality may prevent the chain-reaction explosion of some or all of the remaining rounds packed with the ignited round. While pumice has been shown to be an excellent blast and/or shock absorbing material, it is not easily integrated into a modular reinforcement structure, as it is most effective as a pulverizable pebble. Furthermore, pumice (or perlite materials, which have similar pulverizable characteristics) on its own, cannot prevent the penetration of shrapnel or other projectiles that may accompany the explosion of a bomb.

Thus, there exists a need in the art for a modular panel and/or reinforcing structure that is capable of absorbing and/or redirecting large blast forces (at or near 50 ksi, for example) that may be exerted on existing structures or structural components. There further exists a need in the art for such a modular panel and/or reinforcing structure that combines excellent shock absorption characteristics with other characteristics (such as, for example anti-ballistic capabilities, shrapnel protection, and/or blast-deflection capabilities) that may better protect a potentially vulnerable structure.

BRIEF SUMMARY OF THE INVENTION

The embodiments of the present invention satisfy the needs listed above and provide other advantages as described below. Embodiments of the present invention may include a blast-resistant assembly adapted to be operably engaged with an existing structural element to protect the existing structural element from an applied force (such as an explosive force and/or shock resulting from a detonated explosive device). In one embodiment, the assembly comprises a first ballistic-resistant composite panel, and a second ballistic-resistant composite panel disposed substantially parallel to and spaced apart from the first ballistic-resistant composite panel. The assembly further comprises an energy absorbing core operably engaged between the first ballistic-resistant composite panel and the second ballistic-resistant composite panel. In some embodiments, the energy absorbing core comprises a composite material configured to absorb at least a portion of the applied force by pulverizing in response to the applied force. For example, the energy absorbing core may comprise a particulate pulverizable material suspended in a matrix material. According to some such embodiments, the pulverizable material may include, but is not limited to: pumice; perlite; urethane foam; PVC foam; aluminum foam; aluminum honeycomb; balsa; and combinations of such materials.

The modular assembly embodiments of the present invention may be contoured and/or shaped to fit the contours of an existing structural element. For example, in some embodiments, the ballistic-resistant composite panels and the energy absorbing composite core may be substantially flat so as to be adapted to be operably engaged with an existing structural element having a substantially flat surface (such as a substantially flat vertical wall and/or a substantially flat angled or horizontal roof surface). In other embodiments, the ballistic-resistant composite panels and the energy absorbing core may be curved so as to be adapted to be operably engaged with an existing structural element having a curved surface (such as, for example, the interior of a structure having a circular cross-section, and/or a roof of a domed and/or semi-cylindrical structure).

According to various assembly embodiments of the present invention, the first and second ballistic-resistant composite panels may comprise a variety of composite materials configured to stop and/or decelerate shrapnel or other projectiles and to prevent the incursion of such materials into the energy absorbing core. For example, the first and second ballistic-resistant composite panels may comprise materials including, but not limited to: fiber reinforced polymer materials; fiber reinforced polymer composites; solid laminates; and combinations of such ballistic-resistant materials. For example, in some embodiments, the ballistic-resistant composite panels may comprise a fiber component disposed substantially within a resin component wherein the fiber component may include, but is not limited to: s-glass; aramid fiber; carbon; polyethylene; polybenzoxazole (PBO); nylon; steel wire; polyester cord; and combinations of such fibers. Furthermore, according to such embodiments, the resin component may include, but is not limited to: vinyl ester resin; epoxy; phenolics; and combinations of such resin components.

In order to deflect at least some of the applied force laterally and/or otherwise away from the existing structural element, some assembly embodiments of the present invention further comprise an energy deflecting panel operably engaged with at least one of the first and second ballistic-resistant composite panels. In some embodiments, the energy deflecting panel may comprise a sacrificial material configured to crack in response to the applied force so as to deflect the applied force away from the existing structural element. According to some such embodiments, the sacrificial material of the facing may include, but is not limited to: granite; quartz composite; steel; aluminum; manganese; ceramic; fiber reinforced polymer material comprising a fiber component disposed substantially within a resin component; and combinations of such materials. In other embodiments, the energy deflecting panel may comprise a plurality of substantially rigid particles at least partially suspended in a substantially elastic matrix such that the applied force is at least partially deflected by a movement of the plurality of substantially rigid particles within the substantially elastic matrix in response to the applied force. According to some such embodiments, the plurality of substantially rigid particles may comprise a ceramic armor material and the substantially elastic matrix may comprise a high-tensile strength polymer material.

In order to provide further energy absorption characteristics, some assembly embodiments of the present invention may comprise additional energy-absorbing layers. For example, some assembly embodiments may further comprise a foam panel disposed between the energy deflecting panel and the second ballistic resistant panel. In some embodiments, the foam panel may comprise a syntactic foam material. In some additional embodiments, the assembly may further comprise a substantially compliant material disposed on at least one side of the energy deflecting panel for absorbing at least a portion of the applied force. In such embodiments, the substantially compliant material may include, but is not limited to: rubber; polyurea coating; and combinations of such energy absorbing materials.

Furthermore, various embodiments of the present invention may comprise an aperture defined in the assembly (and/or in an energy deflecting panel, ballistic-resistant composite panel, and/or energy absorbing core thereof) for receiving a connector for operably engaging the assembly with a surface of the existing structural assembly. In some embodiments, the assembly further comprises a bracket disposed between the existing structural assembly and at least one of the first ballistic-resistant composite panel and the second ballistic-resistant composite panel for operably engaging the assembly with a surface of the existing structural assembly. Such brackets may be used, for example, when the surface of the existing structural assembly (such as a structural rib) is substantially perpendicular to the assembly.

Various embodiments may further comprise one or more adhesive layers for adhering the various layers and/or components of the assembly together to form a substantially modular reinforcing assembly. For example, some embodiments comprise an adhesive layer disposed between at least one of the ballistic-resistant composite panels and the energy absorbing composite core for adhering at least one of the ballistic-resistant composite panels to the energy absorbing composite core to form a modular blast-resistant assembly. In addition, some embodiments may further comprise an adhesive layer disposed between at least one of the ballistic-resistant composite panels and the energy deflecting panel for adhering at least one of the ballistic-resistant composite panels to the energy deflecting panel to form a modular blast-resistant assembly having an energy deflecting panel. According to some such embodiments, the adhesive layer may comprise adhesive compounds that may include, but are not limited to: polyurethane adhesives; methacrylate adhesives; and combinations of such adhesives.

Some embodiments of the present invention further provide a blast-resistant reinforcement system adapted to be operably engaged with a particular type of existing structure (such as, for example, an interior surface of a structure) to protect the structure from an applied force (such as an explosion) originating from a location inside the structure. Such reinforcement system embodiments comprise a plurality of energy absorbing panels adapted to be operably engaged with the interior surface of the structure. As described herein, one or more of the plurality of energy absorbing panels may comprise an energy absorbing core comprising a composite material configured to absorb at least a portion of the applied force by pulverizing in response to the applied force. Such reinforcement system embodiments further comprise a plurality of energy deflecting panels configured to be operably engaged with the plurality of energy absorbing panels. The energy deflecting panels may, in turn, be disposed between the plurality of the energy absorbing panels and the location of the applied force so as to deflect at least a portion of the applied force away from the energy absorbing panels and the existing structure behind the energy absorbing panels.

In some such reinforcement system embodiments, the system may be configured to be capable of being operably engaged with a structure having a substantially circular cross-section such that the interior surface thereof is curved. According to such embodiments, the energy absorbing panels may be disposed substantially adjacent to one another about the interior surface of the structure such that as the energy absorbing composite core pulverizes in response to the applied force, each of the energy absorbing panels are urged further into contact with one another about the curved interior surface of the structure. Thus, according to such embodiments, the energy absorbing panels may be "locked" into contact in response to a blast that originates inside the structure.

Furthermore, according to some reinforcement system embodiments, the energy deflecting panels may be arranged relative to the energy absorbing panels so that none of the seams of these two component layers are co-located. For example, the energy deflecting panels may be operably engaged with the energy absorbing panels such that a first seam defined between each of the plurality of energy absorbing panels is not co-located with a second seam defined between each of the plurality of energy deflecting panels about the interior surface of the structure.

Furthermore, and as described above, each modular energy absorbing panel of the reinforcement system may further comprise several composite layers to improve the blast resistance and the ballistic resistance of each energy absorbing panel forming the reinforcement system. For example, in some embodiments, each of the plurality of energy absorbing panels may comprise: a first ballistic-resistant composite panel; a second ballistic-resistant composite panel disposed substantially parallel to and spaced apart from the first ballistic-resistant composite panel; and the energy absorbing core operably engaged between the first ballistic-resistant composite panel and the second ballistic-resistant composite panel.

Thus the various embodiments of the present invention provide many advantages that may include, but are not limited to: providing a modular blast-resistant assembly that may be easily attached to a variety of existing structural elements as bolt-on elements; providing a blast-resistant assembly that packages the shock-absorption capability of a pulverizable material in a robust and modular structural format; providing a blast-resistant assembly that includes a blast-deflection capability and a shock-absorption capability; and providing a complete reinforcement system for an existing interior surface of a structure including a plurality of interconnected modular blast-resistant panels. These advantages, and others that will be evident to those skilled in the art, are provided in the various embodiments of the present invention.

BRIEF DESCRIPTION OF THE SEVERAL VIEWS OF THE DRAWINGS

Figure 1:
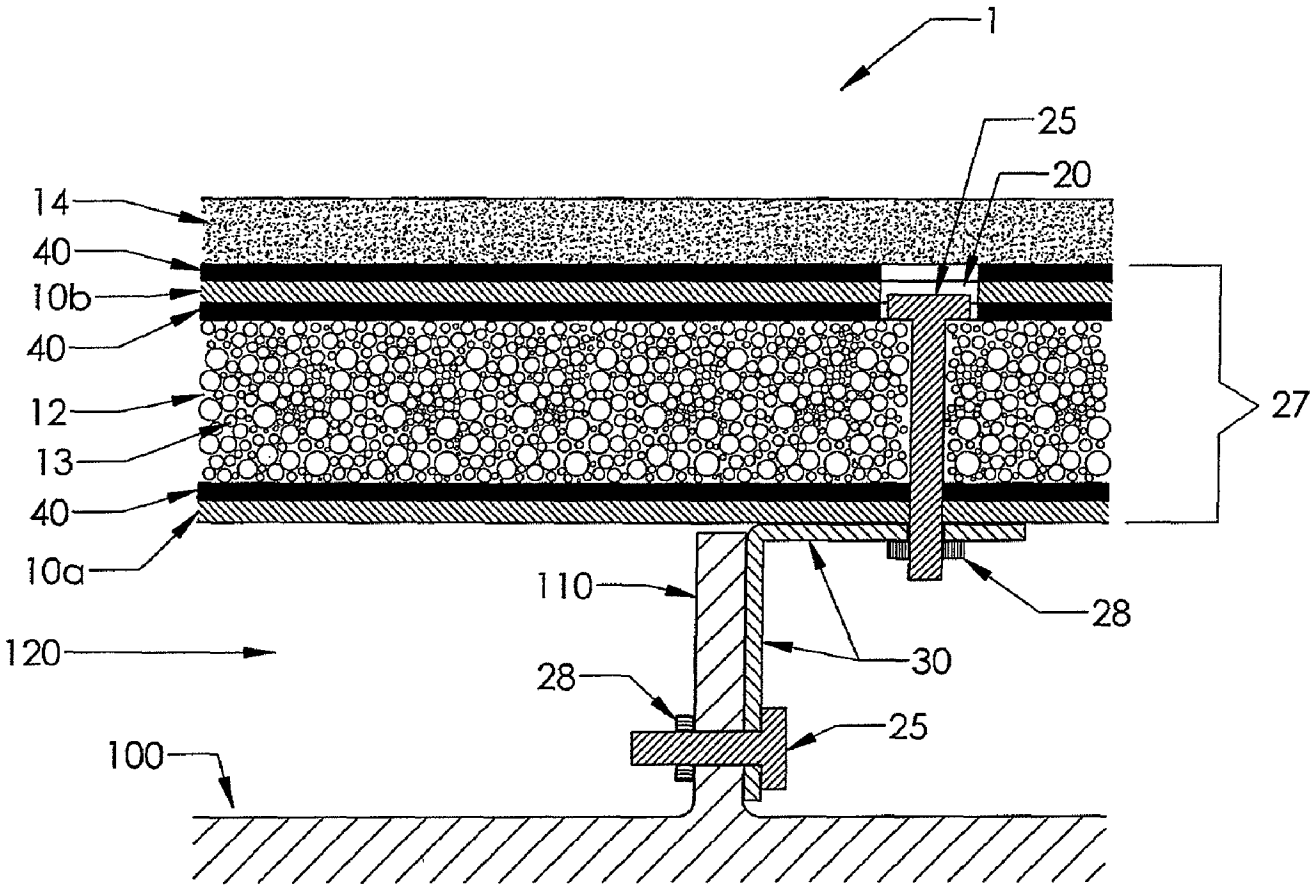
Figure 2:
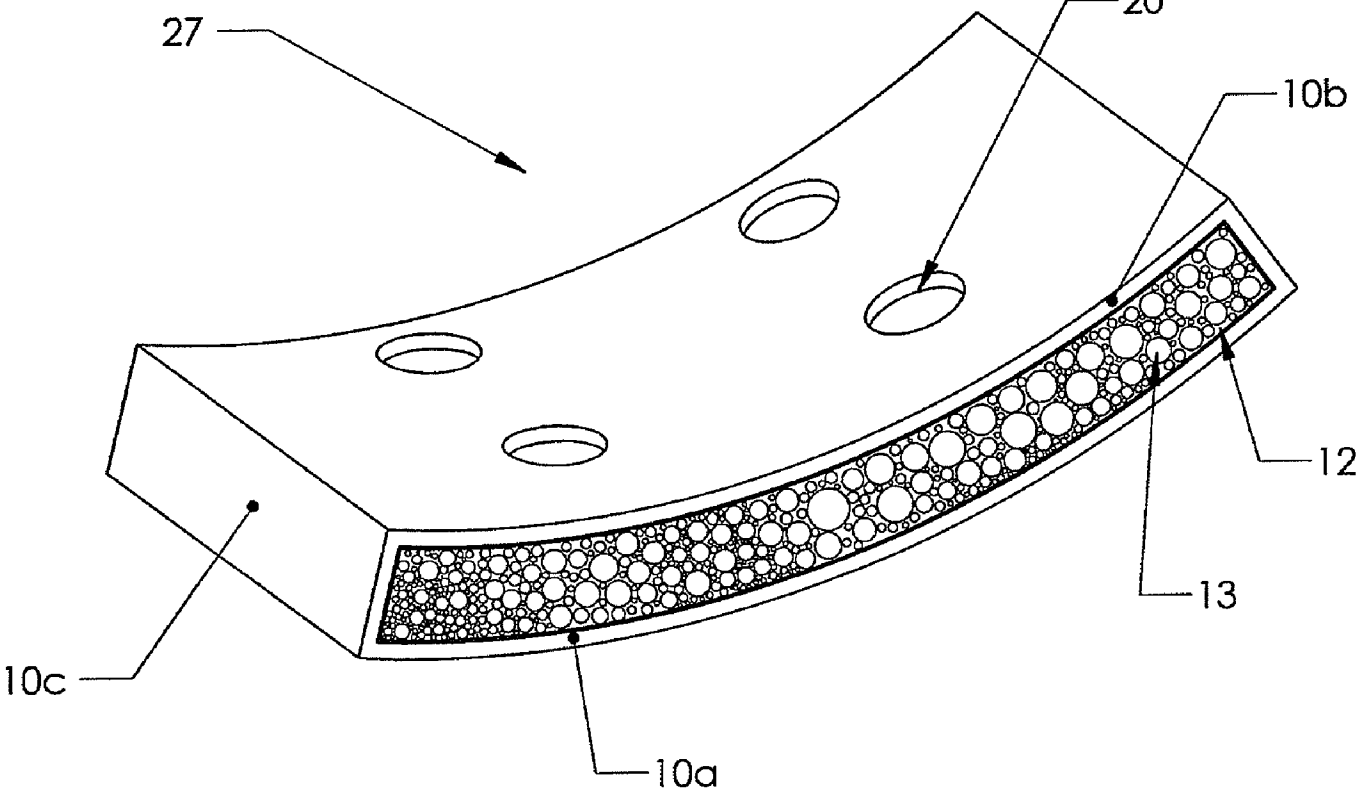
Figure 3:
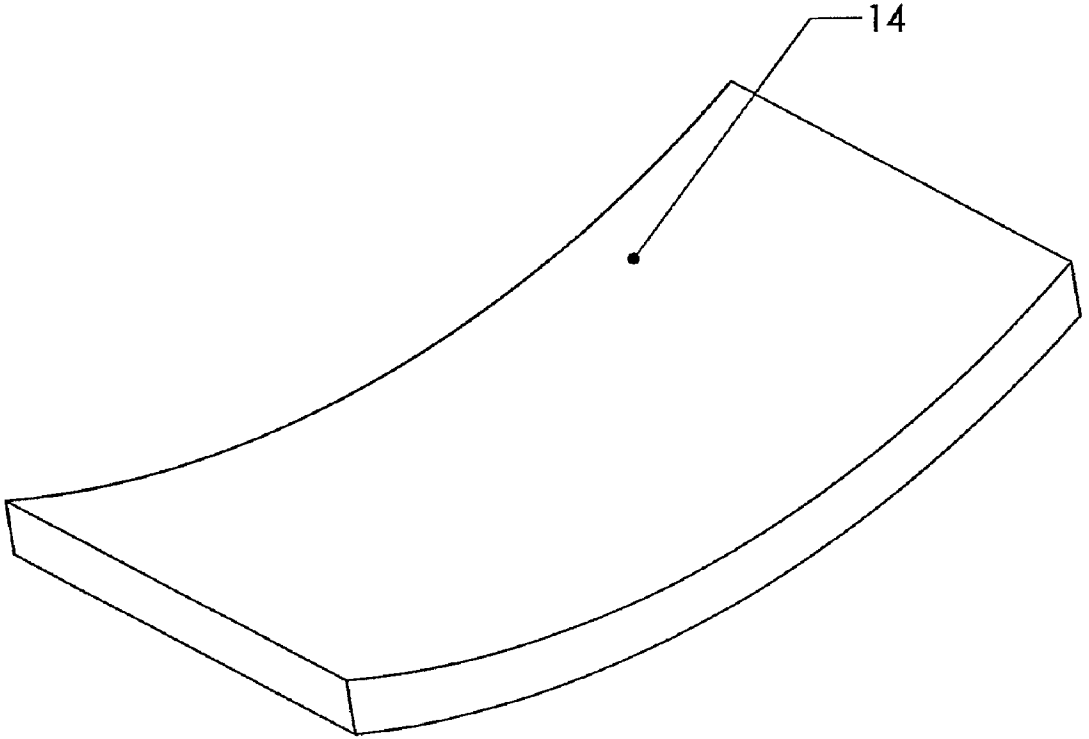
Figure 4:
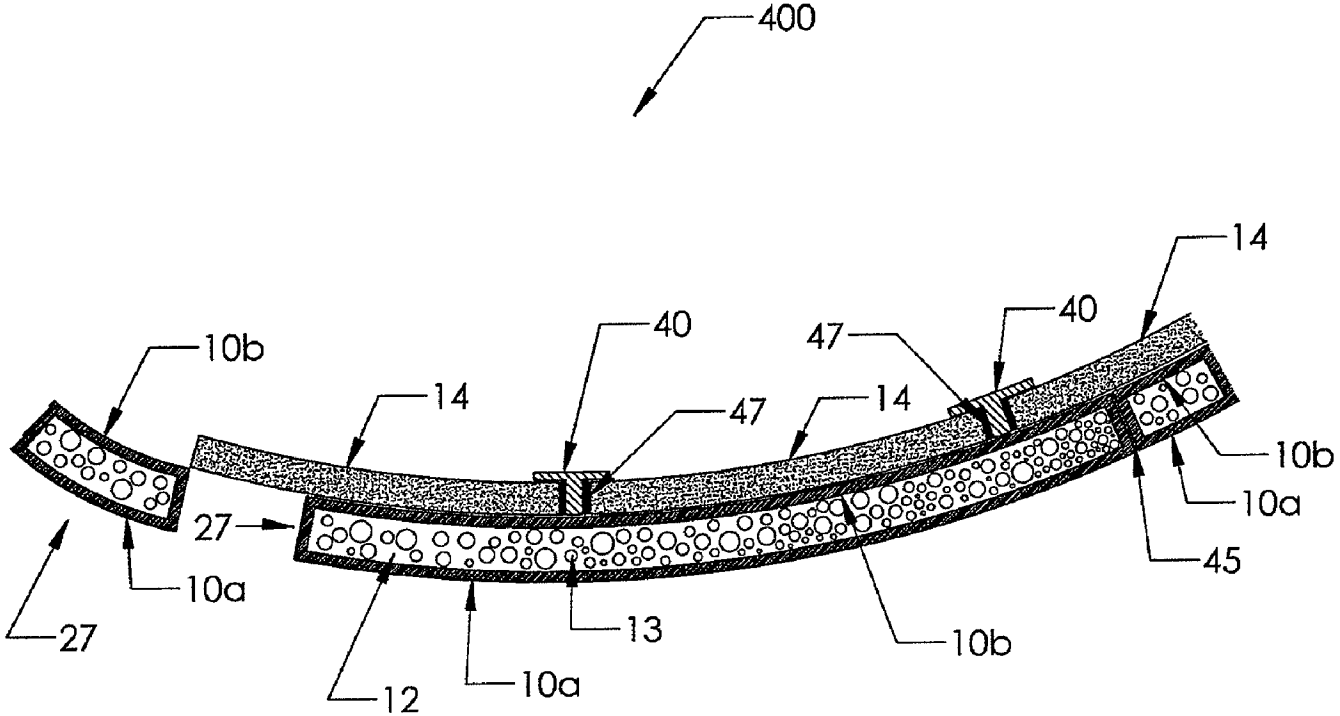
Figure 5:
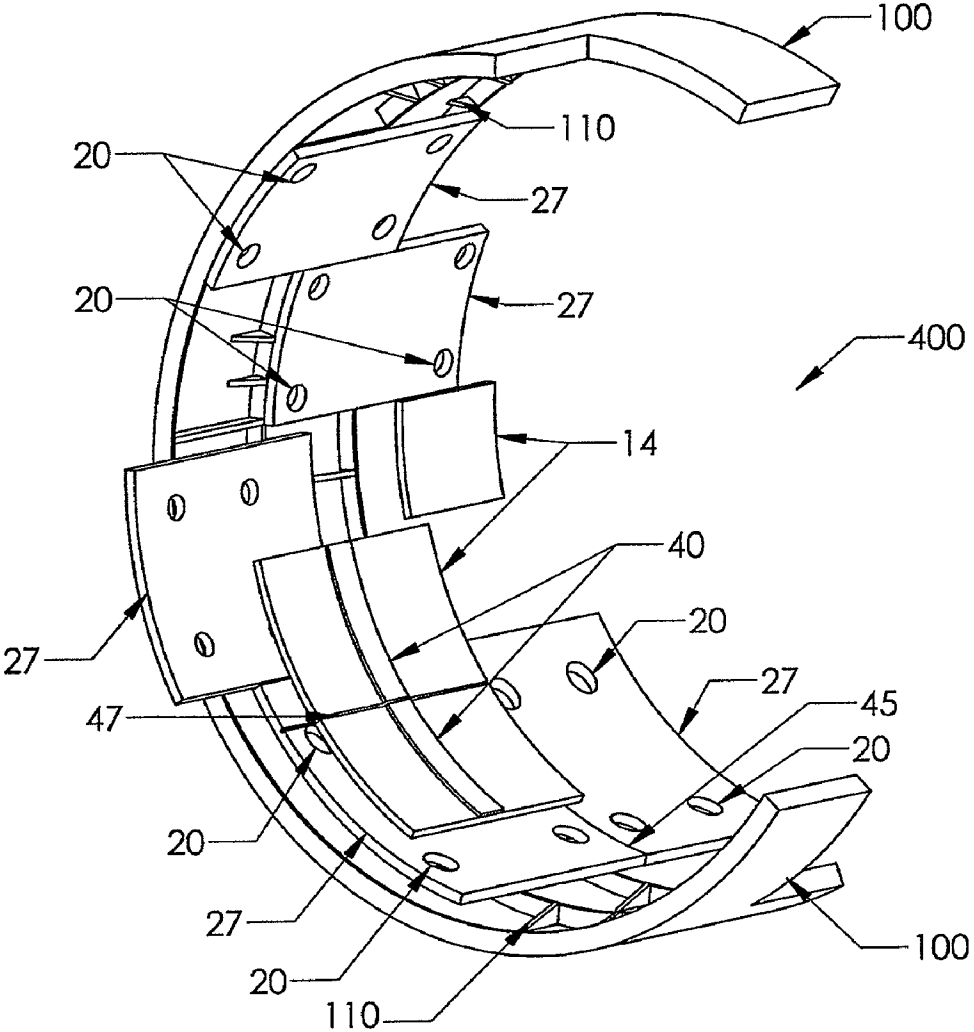
Figure 6:
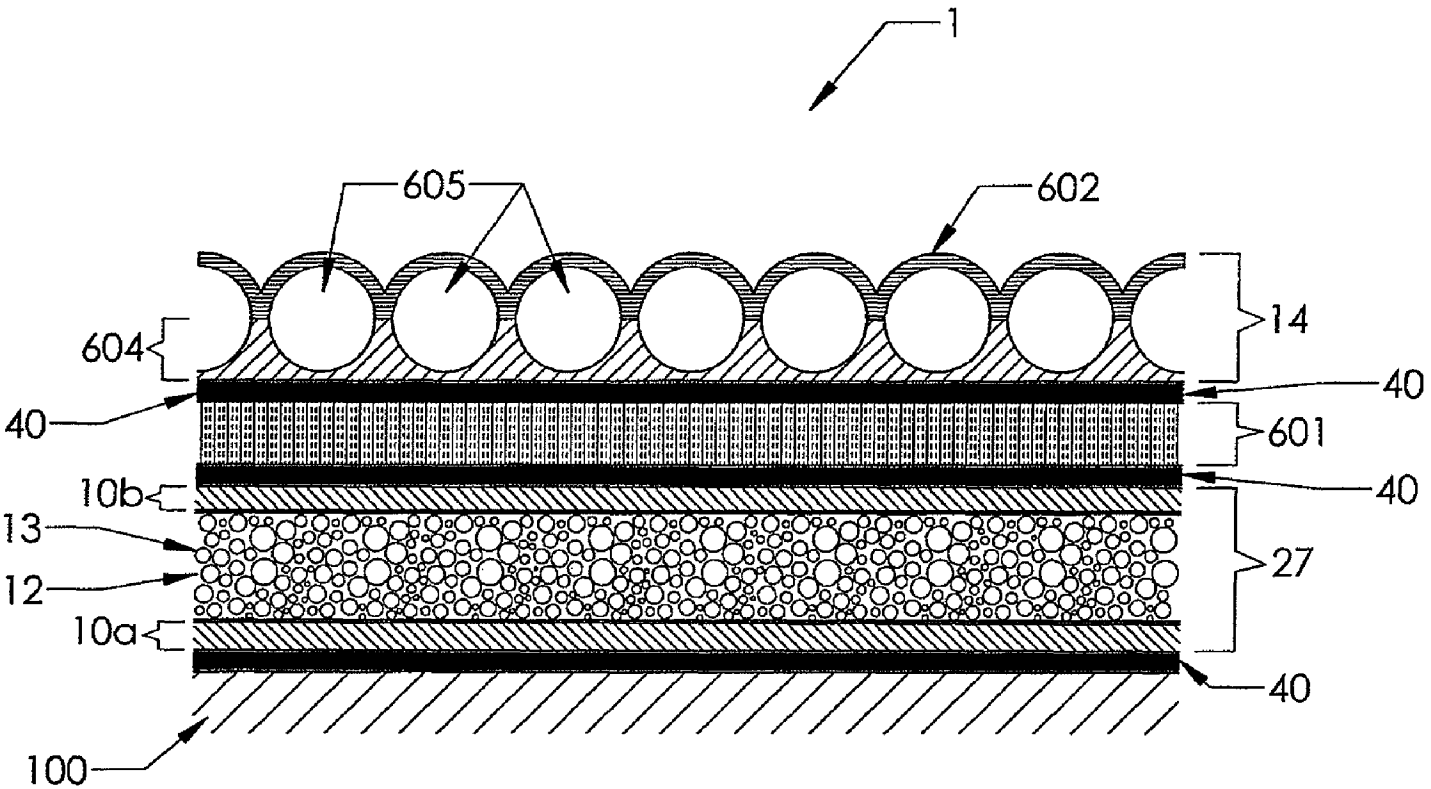

Having thus described the invention in general terms, reference will now be made to the accompanying drawings, which are not necessarily drawn to scale, and wherein:

FIG. 1 is cross-sectional view of a blast-resistant assembly operably engaged with an existing structural element, according to one embodiment of the present invention;

FIG. 2 is a perspective view of an energy absorbing panel according to one embodiment of the present invention;

FIG. 3 is a perspective view of an energy deflecting panel according to one embodiment of the present invention;

FIG. 4 is a cross sectional view of a curved blast-resistant reinforcement system according to one embodiment of the present invention;

FIG. 5 is a perspective view of a blast-resistant reinforcement system operably engaged with an interior surface of a tunnel, according to one embodiment of the present invention; and FIG. 6 is a cross-sectional view of a blast-resistant assembly including an energy-deflecting panel comprising a plurality of substantially rigid particles at least partially suspended in a substantially elastic matrix.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. The singular forms "a," "an," and "the" include plural referents unless the context clearly dictates otherwise.

Although some embodiments of the invention described herein are described in terms of a blast-resistant reinforcement system adapted to be operably engaged with an interior structure of a tunnel system, it will be appreciated by one skilled in the art that the invention is not so limited. For example, as shown generally in FIG. 1, embodiments of the blast-resistant assembly 1 and the blast-resistant reinforcement system 400 (see FIGS. 4 and 5, for example) described generally herein may also be adapted to be operably engaged with and/or reinforce various other types of interior and/or exterior structural elements including, but not limited to: substantially flat vertical walls; substantially flat horizontal roofs and floors; curved roofs; curved walls; ribbed structural elements; trusses; I beams; H beams; cantilevered reinforced concrete structures; steel bridge structures; reinforced concrete bridge structures; and/or combinations of such structural elements. As described herein, the blast-resistant assembly 1 and reinforcement system 400 described herein provides a highly modular, adaptable and robust system for retrofitting and/or reinforcing structural elements such that such elements may exhibit improved survivability and/or resistance to applied forces (such as shock and/or blast forces resulting from explosive detonation).

Referring to FIG. 1, one embodiment of the present invention provides a blast-resistant assembly 1 adapted to be operably engaged with an existing structural element 100 to protect the existing structural element 100 from an applied force (such as, for example, a shock and/or blast force resulting from an explosion). In one embodiment, the assembly comprises a first ballistic-resistant composite panel 10*a* (which, as shown in FIG. 1, may be disposed adjacent to the existing structural element 100), a second ballistic-resistant composite panel 10*b* disposed substantially parallel to and spaced apart from the first ballistic-resistant composite panel 10*a*, and an energy absorbing core 12 operably engaged between the first ballistic-resistant composite panel 10*a* and the second ballistic-resistant composite panel 10*b*. As described further herein, the energy absorbing composite core 12 may comprise a composite material configured to absorb at least a portion of the applied force by pulverizing in response to the applied force.

The energy absorbing core 12 may comprise a pulverizable material 13 suspended in a matrix material or other binder component. The pulverizable material 13 may be configured to absorb the energy transmitted by the applied force (such as a shock wave and/or blast force generated by an explosion) by pulverizing into smaller components in response to the applied force. For example, the energy of a shock wave and/or blast force may be dissipated in breaking down the pulverizable material 13 into smaller components such that only some portion of the initial applied force is actually transmitted to the existing structural element 100. Furthermore, in some embodiments, the pulverizable material 13 may be provided in particles of various sizes (including some relatively large size particles) such that some secondary applied forces (such as secondary blasts and/or additional explosive blasts) may be further absorbed in a second pulverizing cycle before the pulverizable material 13 is fully broken down into a fine powder (which may be less capable of absorbing and/or dissipating the applied force). In some embodiments, the energy absorbing core 12 may comprise pulverizable material 13 (in particulate form or other forms) that may include, but is not limited to: pumice; perlite; urethane foam; PVC foam; aluminum foam; aluminum honeycomb; balsa; and combinations of such pulverizable materials. The matrix in which the pulverizable material 13 may be suspended may include, but is not limited to: an epoxy matrix, a semiliquid matrix; a polymer matrix; an adhesive matrix; and combinations of such matrix materials.

For example, in one embodiment, the pulverizable material 13 may comprise a plurality of individual particles of pulverizable material 13 (such as pumice "pebbles" for example) of a selected size distribution suspended in a matrix comprising a matrix material (such as an epoxy, for example). According to such embodiments, the size distribution of the particles of pulverizable material 13 may range from ¼ (one quarter) inch to 1 (one) inch. In one embodiment, the pulverizable material 13 may comprise particles having a preferred size of about ⅜ (three eighths) inches. As described herein, the size distribution of the particles of pulverizable material 13 may also be substantially bi-modal by volume such that the energy absorbing core 12 may be capable of absorbing at least one primary applied force and one or more secondary applied forces (such as those resulting from secondary blasts, for example) by further pulverizing the largest particles of pulverizable material 13 remaining after the application of a first force.

The pulverizable material 13 of the energy absorbing core 12 may be effective for absorbing the energy transmitted by an applied force (such as a shock wave and/or blast force) but that the pulverizable material 13 may do little to impede the advance of particles, shrapnel, and/or debris that may accompany the application of a blast force. Such fast-moving materials may be hazardous to the integrity of the existing structural element 100 if allowed to impact some portions of the existing structural element 100. Thus, as described herein with reference to FIGS. 1 and 2, some blast-resistant assembly 1 embodiments of the present invention may further comprise first and second ballistic-resistant composite panels 10*a*, 10*b* that may surround and/or encase the pulverizable material 13 of the energy absorbing core 12. The resulting energy absorbing panels 27 (see FIG. 2, for example) may thus provide a modular blast-resistant assembly 1 that is not only capable of at least partially absorbing a large applied force, but also preventing the advance of shrapnel or other debris that may be propelled towards the existing structural element 100 by the applied force. For example, in one embodiment, the "ballistic-resistance" of the ballistic-resistant composite panels 10*a*, 10*b* may be characterized by substantial compliance with Underwriters Laboratories' Standard for Safety for Bullet-Resisting Equipment (UL 752)—Level III, and/or the National Institute of Justice's standard, Ballistic Resistant Protective Materials (NIJ 0108.01)—Level IIIA.

In particular embodiments, the energy absorbing core 12 may comprise a foam material, especially syntactic foams. In a preferred embodiment, the energy absorbing core 12 comprises a NSL-8 flexible epoxy syntactic foam available commercially from Thermal Coating Technologies, Inc. of Opelousas, La.

In order to ensure that the energy absorbing panels 27 (and the resulting blast-resistant assembly 1) are relatively lightweight and robust, the ballistic-resistant composite panels 10*a*, 10*b* may comprise specialty composite materials that may include, but are not limited to: a fiber reinforced polymer material; a fiber reinforced polymer composite; a solid laminate; and combinations of such materials.

For example, the ballistic-resistant composite panels 10*a*, 10*b* may comprise fiber reinforced polymer material including a fiber component disposed substantially within a resin component, wherein the fiber component may include, but is not limited to: s-glass; aramid fiber (such as KEVLAR®, for example); carbon; polyethylene; polybenzoxazole; nylon; steel wire; polyester cord; and combinations of such fiber components. Furthermore, in some such embodiments, the resin component may include, but is not limited to: vinyl ester resin; epoxy; phenolics; and combinations of such resin components. The ballistic-resistant composite panels 10*a*, 10*b* may also comprise pre-fabricated ballistic-resistant composite panels such as, for example, ballistic-resistant fiberglass laminate panels available from Martin Marietta Composites of Raleigh, N.C.

Furthermore, in some assembly 1 embodiments, one or more of the ballistic-resistant composite panels 10*a*, 10*b* may also comprise a fiber reinforced polymer composite such as a vacuum-infused sandwich panel comprising an upper skin and a lower skin and a core material disposed substantially between the upper and lower skins. Exemplary core materials of the first composite material may include, but are not limited to: wood, foam, and various types of honeycomb. Other core materials may also include, but are not limited to: web materials embedded in a thermosetting resin and fiber-reinforced polymer resin materials. The upper and lower skins may also comprise composite materials such as polymer resin materials including fiber reinforcing elements embedded therein. Exemplary polymer resin materials may include, but are not limited to: thermosetting resins, such as unsaturated polyesters, vinyl esters, polyurethanes, epoxies, phenolics, and mixtures thereof. The fiber reinforcing elements may include, but are not limited to: E-glass fibers, S-glass, carbon fibers, KEVLAR®, metal (e.g., metal nano-fibers), high modulus organic fibers (e.g., aromatic polyamides, polybenzamidazoles (PBOs), and aromatic polyimides), and other organic fibers (e.g., polyethylene and nylon). Blends and hybrids of such materials may also be used as a reinforcing element. Other suitable composite materials that may be used as a reinforcing element within components of the first composite material may include, but are not limited to: whiskers and fibers constructed of boron, aluminum silicate, or basalt. Exemplary fiber reinforced panels that may be used as a composite floor member and methods of making such panels are disclosed in the following U.S. patents: U.S. Pat. Nos. 5,794,402; 6,023,806; 6,044,607; 6,108,998; 6,645,333; and 6,676,785, all of which are incorporated herein in their entirety. In addition, according to some embodiments of the assembly 1 of the present invention, one or more of the ballistic-resistant composite panels 10*a*, 10*b* may also comprise a TRANSONITE® composite panel (also available from Martin Marietta Composites of Raleigh, N.C.). According to some embodiments, the core of a sandwich panel used to form one or more of the ballistic-resistant composite panels 10*a*, 10*b* may be formed of a foam material with a plurality of fibers extending through the foam and connecting the two laminated skins secured to each opposing surface of the foam core. Furthermore, in some embodiments, the energy absorbing panel 27 (see FIG. 2, for example) may comprise a plurality of fibers (not shown) extending through the energy absorbing core 12 and connecting the two ballistic-resistant composite panels 10*a*, 10*b* secured to each opposing surface of the energy absorbing core 12.

As shown generally in FIG. 1, the assembly 1 may further comprise an energy deflecting panel 14 operably engaged with at least one of the first and second ballistic-resistant composite panels 10*a*, 10*b* so that the energy deflecting panel 14 is positioned between the energy absorbing panel 27 and the origin of the applied force (such as the location of an explosive detonation) (see FIG. 5, for example, showing a plurality of energy deflecting panels 14 disposed on a surface defined by a plurality of energy absorbing panels 27 on the interior of an existing tunnel structure 100). The energy deflecting panel 14 comprises a sacrificial material configured to crack in response to the applied force so as to deflect the applied force substantially laterally and away from the existing structural element 100. As described herein, the sacrificial material of the energy deflecting panel 14 is configured to crack in response to the applied force so as to deflect the applied force and/or reduce the force that may be transmitted to the energy absorbing panel 27 (and the pulverizable material 13 disposed therein). Thus, the sacrificial material of the energy deflecting panel 14 may include, but is not limited to: granite; quartz composite; steel; aluminum; manganese; ceramic; fiber reinforced polymer material comprising a fiber component disposed substantially within a resin component; and combinations of such embodiments. For example, in one embodiment, the energy deflecting panel 14 comprises "Virginia Mist" granite slabs available from the North Carolina Granite Corporation of Mount Airy, N.C.

Furthermore, as shown generally in FIG. 6, in some assembly 1 embodiments, the energy deflecting panel 14 may comprise a plurality of substantially rigid particles 605 at least partially suspended in a substantially elastic matrix 604 such that the applied force is at least partially deflected by a movement of the plurality of substantially rigid particles 605 within the substantially elastic matrix 604 in response to the applied force. According to some such embodiments, the plurality of substantially rigid particles 605 may comprise a ceramic armor material such as, for example, particles formed from CERASHIELD™ ceramic armor materials available from CoorsTek, Inc. of Golden, Colo. The rigid particles may be formed from materials that may include, but are not limited to: 90% alumina ceramic; 96% alumina ceramic; 98% alumina ceramic; 98.5% alumina ceramic; 99% alumina ceramic; 99.5% alumina ceramic; zirconia-toughened alumina; direct-sintered silicon carbide; reaction-bonded silicon carbide; and reaction-bonded boron carbide. The particles 605 may be formed in a variety of shapes that may include, but are not limited to: spheroid; flattened spheroid; cylinder; cube; and other particle shapes. For example, in some embodiments, the particles 605 may comprise flattened spheroids having an approximate diameter of three quarters of one inch (¾"). Furthermore, in some such embodiments, the substantially elastic matrix 604 may comprise a high-tensile strength polymer material that may include, but is not limited to VIBRATHANE® 8011 liquid prepolymer (available commercially from Uniroyal Chemical) cured with a diamine curative (such as, for example, VERSALINK® 740M curative, available from Air Products and Chemicals, Inc. of Allentown, Pa.).

Referring again to FIG. 6, some assembly embodiments of the present invention may also comprise an energy-absorbing foam panel 601 disposed between the energy deflecting panel 14 and the second ballistic resistant panel 10*b* of the energy absorbing panel 27. In some such embodiments, the foam panel 601 may comprise a syntactic foam material, such as, for example, NSL-8 flexible epoxy syntactic foam available commercially from Thermal Coating Technologies, Inc. of Opelousas, La.

As described herein, and as shown generally in FIG. 1, the assembly 1 embodiments of the present invention (and the various energy deflecting panel 14, and energy absorbing panel 27 components thereof) are modular and capable of being operably engaged with a variety of existing structural surfaces. In order to facilitate "bolt-on" attachment of the assembly 1 to an existing structure, some assembly 1 embodiments may comprise an aperture 20 defined therein for receiving a connector 25 for operably engaging the assembly 1 with a surface of the existing structural assembly 100. As shown generally in FIG. 1, the aperture 20 may further define a countersink defined in the outermost ballistic-resistant composite panel 10*b* such that a connector 25 (and/or a bolt head thereof, in some embodiments) may be disposed substantially flush with a surface of the energy absorbing panel 27. In other embodiments (not shown), the aperture may be widened such that a bolt head or other bearing surface of the connector 25 is disposed substantially adjacent to the innermost ballistic-resistant composite panel 10*a* (as the force exerted by the connector 25 relative to a bolt 28 operably engaged therewith, may prematurely compress and/or pulverize the pulverizable material 13 of the of the energy absorbing core 12). The aperture 20 may also define an access point such that a tool (a wrench, or powered driver, for example) may access a bolt head or other component of the connector 25 during the engagement of the energy absorbing panel 27 with the existing structure 100 (or a component 110 thereof). Furthermore, according to various embodiments, the energy absorbing panel 27 (and/or a component layer thereof) may also be operably engaged with existing structure 100 via various types of fasteners, including, but not limited to: screws, bolts, rivets, toggle fasteners, and combinations thereof.

Furthermore, as shown generally in FIG. 1, some assembly 1 embodiments of the present invention may further comprise a bracket 30 disposed between the existing structural assembly 100 and at least one of the ballistic-resistant composite panels 10*a*, 10*b* for operably engaging the assembly 1 with a surface 110 of the existing structural assembly, wherein the surface 110 is substantially perpendicular to the assembly 1. For example, and as shown generally in FIG. 1, the bracket 30 may facilitate the "bolt-on" attachment of at least one component of the assembly 1 (such as the energy absorbing panel 27, as shown generally in FIG. 1) with a surface of a structural rib or other surface 110 of the existing structural assembly 100 that is substantially perpendicular to the blast-resistant assembly 1. Thus, the use of a bracket 30 (in combination with one or more connectors 25 (that may include, but are not limited to screws, bolts, rivets and toggle fasteners)) may facilitate the reinforcement of an existing iron, steel, and/or wooden structure that utilizes bolts extending through structural ribs or other surfaces 110, by allowing for the direct integration of the blast-resistant assembly 1 into the existing structure 100 (as shown, for example, in the tunnel reinforcement example described in conjunction with FIG. 5).

While bolts or other connectors 25 may be used to facilitate the engagement of one or more components of the modular blast-resistant assembly 1 with one or more elements of an existing structure 100, the assembly 1 may also comprise one or more adhesive layers 40 for operably engaging the components of the modular blast-resistant assembly 1 with one another and/or with the existing structure 100. For example, as shown in FIG. 1, the assembly 1 may comprise an adhesive layer 40 disposed between at least one of the ballistic-resistant composite panels 10*a*,10*b* and the energy absorbing composite core 12 for adhering at least one of the ballistic-resistant composite panels 10*a*, 10*b* to the energy absorbing core 12 to form the blast-resistant assembly 1.

Furthermore, and also as shown in FIG. 1, the assembly 1 may also comprise an additional adhesive layer 40 disposed between at least one of the ballistic-resistant composite panels 10*a*, 10*b* (such as an outermost ballistic-resistant composite panel 10*b*, for example) and the energy deflecting panel 14 for adhering at least one at least one of the ballistic-resistant composite panels 10*a*, 10*b* to the energy deflecting panel 14 to form the blast-resistant assembly 1. Furthermore, one or more additional adhesive layers 40 may also be disposed substantially between an innermost ballistic-resistant composite panel 10*a* and the existing structure 100 to supplement and/or replace the connectors 25 and/or brackets 30 for operably engaging the assembly 1 with the existing structure 100. As shown generally in FIG. 6, the use of adhesive layers 40 may be especially useful for operably engaging a substantially flat blast-resistant assembly 1 with a corresponding substantially flat outer surface of an existing structure 100. According to such assembly embodiments, the adhesive layer 40 may comprise various adhesive compounds including, but not limited to: polyurethane adhesives; methacrylate adhesives; and combinations thereof. Furthermore, as shown in FIG. 6, additional adhesive layers 40 may be utilized to operably engage various surfaces of the foam panel 601 with adjacent assembly 1 components that may include, but are not limited to the energy deflecting panel 14 and the energy absorbing panel 27.

As shown, for example, in FIG. 6, some additional assembly 1 embodiments of the present invention may further comprise a substantially compliant material 602 disposed on at least one side of the energy deflecting panel 14 for absorbing at least a portion of the applied force. In other embodiments, the substantially compliant material may be used to substantially fill an aperture 120 defined, for example, between the blast-resistant assembly 1 and the existing structure 100 (as shown in FIG. 1, for example). In other embodiments, the substantially compliant material may comprise a substantially thin and/or "spray-on" coating applied to an innermost ballistic-resistant composite panel 10*b* and/or an outer surface of the existing structure 100 before operably engaging the energy absorbing panel 27 therewith. The substantially compliant material may comprise a material including, but not limited to: rubber; polyurea coating; and combinations thereof.

As described herein, the shape of the assembly 1 and the various components 27, 14 thereof may be tailored for application to various existing structures. For example, in some embodiments, as shown in FIG. 1, the first ballistic-resistant composite panel 10*a*, the second ballistic-resistant composite panel 10*b*, the energy absorbing composite core 12 (and the energy deflecting panel 14) may be formed in a substantially flat configuration so as to be adapted to be operably engaged with an existing structural element 100 having a substantially flat surface (and/or having a plurality of structural ribs 110 extending to form a substantially level attachment surface). Alternatively, as shown in FIG. 5, for example, the first ballistic-resistant composite panel 10*a*, the second ballistic-resistant composite panel 10*b*, the energy absorbing composite core 12 (and the energy deflecting panel 14) may be formed in a substantially curved configuration so as to be adapted to be operably engaged with an existing structural element having a curved surface (see also, FIG. 4 (showing a reinforcement system 400 adapted to be operably engaged with a curved structure)). Furthermore, and as shown generally in FIG. 6, the assembly 1 may be formed in a substantially flat configuration such that the assembly 1 may be directly operably engaged with a corresponding flat surface of an existing structural element 100 via an adhesive layer 40.

FIG. 5 shows one embodiment of the assembly 1 of the present invention in use as a component of an integrated blast-resistant reinforcement system 400 adapted to be operably engaged with an interior surface of a tunnel structure 100 to protect the tunnel from an applied force originating from a location inside the tunnel. According to such embodiments, the reinforcement system 400 comprises a plurality of energy absorbing panels 27 adapted to be operably engaged with the interior surface of the tunnel 100 (and/or a steel or iron structural component thereof, as shown in FIG. 5, for example). As described herein with respect to FIG. 1, each of the plurality of energy absorbing panels 27 comprises an energy absorbing core 12 comprising a composite material (such as a pulverizable material 13) configured to absorb at least a portion of the applied force by pulverizing in response to the applied force. As described herein with respect to FIG. 1, for example, each of the plurality of energy absorbing panels 27 may comprise a first ballistic-resistant composite panel 10*a*; a second ballistic-resistant composite panel 10*b* disposed substantially parallel to and spaced apart from the first ballistic-resistant composite panel 10*a*; and the energy absorbing core 12 operably engaged between the first ballistic-resistant composite panel 10*a* and the second ballistic-resistant composite panel 10*b*. As shown in FIGS. 4 and 5, the blast-resistant reinforcement system 400 further comprises a plurality of energy deflecting panels 14 configured to be operably engaged with the energy absorbing panels 27 and disposed between the energy absorbing panels 27 and the location of the applied force (i.e. inside the tunnel structure 100).

As shown generally in FIGS. 4 and 5, the existing structure 100 may define a substantially curved surface (such as the interior of a tunnel structure 100, as shown in FIG. 5). In order to reinforce such existing structures 100, embodiments of the reinforcement system 400 may comprise a plurality of energy absorbing panels 27 disposed substantially adjacent to one another about the interior surface of the tunnel 100 such that as the energy absorbing composite core 12 pulverizes in response to the applied force, each of the plurality of energy absorbing panels 27 are urged further into contact with one another about the curved interior surface of the tunnel structure 100. For example, as one skilled in the art will appreciate, if an explosive device is detonated within a tunnel structure 100 defining a substantially circular cross-section (as shown, for example, in FIG. 5), and if the applied force resulting from the detonation proceeds radially outward from the initial location of the detonation in all directions, the applied force may act on each of the plurality of energy absorbing panels 27 substantially simultaneously such that, as the energy absorbing composite core 12 (and the pulverizable material 13 suspended in a matrix therein) pulverizes in response to the applied force the resulting compression of the energy absorbing panels 27 may cause the energy absorbing panels 27 to be urged further into contact with one another about the curved interior surface of the tunnel structure 100. Thus, the lateral interaction (along a side wall 10*c*, for example, as shown in FIG. 2) of each of the plurality of energy absorbing panels 27 may actually strengthen the overall reinforcement system 400 in response to the applied force.

Furthermore, as shown generally in FIGS. 4 and 5, a reinforcement system 400 comprising a plurality of energy absorbing panels 27 overlaid with a plurality of energy deflecting panels 14 (such as the granite slabs described herein) may be assembled about a surface of an existing structure 100 such that the seams defined between adjacent energy absorbing panels 27 are substantially covered by the body of at least one energy deflecting panel 14 (see, for example, the "overlapped" arrangement of energy deflecting panels 14 relative to underlying energy absorbing panels 27 shown in FIGS. 4 and 5). Thus, the applied force may at least be deflected by the energy deflecting panels 14 before being transmitted to a seam defined between at least two energy absorbing panels 27.

Furthermore, as shown in FIG. 4, the seams defined between adjacent energy deflecting panels 14 may also be protected and/or supported by a plurality of spacing elements 40. The spacing elements 40 may be substantially "T" shaped such that a portion of the spacing element extends upward through the seam between adjacent energy deflecting panels 14 and a facing portion of the spacing element 40 substantially overlaps the otherwise exposed seam defined between adjacent energy deflecting panels 14. Thus, according to such embodiments, the spacing element 40 may at least partially deflect the applied force from the seams defined between adjacent energy deflecting panels 14. According to various embodiments of the present invention, the spacing element 40 may comprise a variety of structural materials including, but not limited to: steel, aluminum, fiber-reinforced composite; and combinations of such materials.

According to some embodiments, the reinforcement system 400 shown in FIG. 5 (at least partially installed in an existing tunnel 100 or other cylindrical structure) may be capable of resisting an applied force generated by an explosion (originating from a location within the structure 100) exerting a blast pressure of at least about 50 ksi. The term "resisting" as used above may refer generally to mitigating at least 50% of the damage caused by the applied force on a structure having no reinforcement system 400 installed. In other embodiments, (comprising additional energy deflecting panels 14; energy absorbing panels 27; foam panels 601; and/or substantially compliant material layers 602), the reinforcement system 400 may allow the existing structure to resist a blast pressure of between about 2 ksi and 150 ksi.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A blast-resistant panel assembly adapted to be operably engaged with an existing structural element to protect the existing structural element from an applied force, the panel assembly comprising:

a first ballistic-resistant composite panel;

a second ballistic-resistant composite panel disposed substantially parallel to and spaced apart from the first ballistic-resistant composite panel;

an energy absorbing core operably engaged between the first ballistic-resistant composite panel and the second ballistic-resistant composite panel, the energy absorbing core being formed of a pulverizable material suspended in a matrix material that is configured to pulverize into smaller components in response to the applied force and thereby absorb at least a portion of the applied force; and an energy deflecting panel operably engaged with the second ballistic-resistant composite panel and configured to crack in response to the applied force and deflect the applied force away from the existing structural element.

2. A panel assembly according to claim 1, wherein each of the first ballistic-resistant composite panel and the second ballistic-resistant composite panel comprises a material selected from the group consisting of:

a fiber reinforced polymer material;

a fiber reinforced polymer composite;

a solid laminate; and combinations thereof.

3. A panel assembly according to claim 2, wherein the fiber reinforced polymer comprises a fiber selected from the group consisting of: s-glass; aramid fiber; carbon;

polyethylene; polybenzoxazole; nylon; steel wire; polyester cord; and combinations thereof.

4. A panel assembly according to claim 3, wherein the fiber reinforced polymer comprises a resin selected from the group consisting of: vinyl ester resin; epoxy;

phenolics; and combinations thereof.

5. A panel assembly according to claim 1, wherein the pulverizable material comprises a particulate.

6. A panel assembly according to claim 1, wherein the pulverizable material is selected from the group consisting of: pumice; perlite; urethane foam;

PVC foam; aluminum foam; aluminum honeycomb; balsa; and combinations thereof.

7. A panel assembly according to claim 1, wherein the energy deflecting panel is configured to deflect the applied force substantially laterally and away from the existing structural element.

8. A panel assembly according to claim 7, wherein the energy deflecting panel comprises a sacrificial material that cracks in response to the applied force, the sacrificial material being selected from the group consisting of: granite; quartz composite; steel; aluminum;

manganese; ceramic; fiber reinforced polymer material comprising a fiber component disposed substantially within a resin component; and combinations thereof.

9. A panel assembly according to claim 7, further comprising a foam panel disposed between the energy deflecting panel and the second ballistic resistant panel.

10. A panel assembly according to claim 9, wherein the foam panel comprises a syntactic foam material.

11. A panel assembly according to claim 7, further comprising an adhesive layer disposed between the second ballistic-resistant composite panel and the energy deflecting panel for adhering the second ballistic-resistant composite panel to the energy deflecting panel.

12. A panel assembly according to claim 1, further comprising an aperture defined through the first ballistic-resistant panel, the second ballistic-resistant panel, and the energy absorbing core for receiving a connector for operably engaging the assembly with a surface of the existing structural assembly.

13. A panel assembly according to claim 1, further comprising a bracket disposed between the existing structural assembly and the first ballistic-resistant composite panel for operably engaging the assembly with a surface of the existing structural assembly, wherein the surface is substantially perpendicular to the assembly.

14. A panel assembly according to claim 1, further comprising an adhesive layer disposed between the ballistic-resistant composite panels and the energy absorbing core for adhering the ballistic-resistant composite panels to the energy absorbing core.

15. A panel assembly according to claim 1, wherein the a first ballistic-resistant composite panel, the second ballistic-resistant composite panel, and the energy absorbing core are substantially flat so as to be adapted to be operably engaged with an existing structural element having a substantially flat surface.

16. A panel assembly according to claim 1, wherein the a first ballistic-resistant composite panel, the second ballistic-resistant composite panel, and the energy absorbing core are curved so as to be adapted to be operably engaged with an existing structural element having a curved surface.

17. A panel assembly according to claim 1, further comprising a substantially compliant material disposed on at least one side of the energy deflecting panel for absorbing at least a portion of the applied force.

18. A panel assembly according to claim 17, wherein the substantially compliant material is selected from the group consisting of:

rubber;

polyurea coating; and combinations thereof.

19. A panel assembly according to claim 1, wherein each of the first ballistic-resistant composite panel and the second ballistic-resistant composite panel comprises at least one of a fiber reinforced polymer material or a fiber reinforced polymer composite.

20. A blast-resistant panel assembly adapted to be operably engaged with an existing structural element to protect the existing structural element from an applied force, the panel assembly comprising:

a first ballistic-resistant composite panel;

a second ballistic-resistant composite panel disposed substantially parallel to and spaced apart from the first ballistic-resistant composite panel;

an energy absorbing core operably engaged between the first ballistic-resistant composite panel and the second ballistic-resistant composite panel, the energy absorbing core being formed of a pulverizable material suspended in a matrix material that is configured to pulverize into smaller components in response to the applied force and thereby absorb at least a portion of the applied force; and an energy deflecting panel operably engaged with the second ballistic-resistant composite panel, the energy deflecting panel comprising a sacrificial material that cracks in response to the applied force, the sacrificial material being selected from the group consisting of: granite; quartz composite; steel; aluminum; manganese; ceramic; fiber reinforced polymer material comprising a fiber component disposed substantially within a resin component; and combinations thereof.

21. A blast-resistant panel assembly according to claim 20, wherein each of the first ballistic-resistant composite panel and the second ballistic-resistant composite panel comprises at least one of a fiber reinforced polymer material or a fiber reinforced polymer composite.

22. A blast-resistant panel assembly adapted to be operably engaged with an existing structural element to protect the existing structural element from an applied force, the panel assembly comprising:

a first ballistic-resistant composite panel;

a second ballistic-resistant composite panel disposed substantially parallel to and spaced apart from the first ballistic-resistant composite panel;

an energy absorbing core operably engaged between the first ballistic-resistant composite panel and the second ballistic-resistant composite panel, the energy absorbing core being formed of a syntactic foam material or a pulverizable material suspended in a matrix material; and an energy deflecting panel operably engaged with the second ballistic-resistant composite panel, the energy deflecting panel comprising a plurality of substantially rigid particles at least partially suspended in a substantially elastic matrix such that the applied force is at least partially deflected by a movement of the plurality of substantially rigid particles within the substantially elastic matrix in response to the applied force.

23. A blast-resistant panel assembly according to claim 22, wherein the plurality of substantially rigid particles comprise a ceramic material.

24. A blast-resistant panel assembly according to claim 22, wherein the energy absorbing core comprises a pulverizable material configured to pulverize into smaller components in response to the applied force and thereby absorb at least a portion of the applied force.

* * * * *